United States Patent [19]

Dewar et al.

[11] 4,078,621

[45] Mar. 14, 1978

[54] DRILLING HEAD

[75] Inventors: Donald M. Dewar, Farmington; James Wilseck, Livonia, both of Mich.

[73] Assignee: Donald M. Dewar, Farmington Hills, Mich.

[21] Appl. No.: 691,285

[22] Filed: Jun. 1, 1976

Related U.S. Application Data

[63] Continuation of Ser. No. 165,654, Jul. 23, 1971, abandoned, which is a continuation-in-part of Ser. No. 58,114, Jul. 24, 1970, Pat. No. 3,710,879.

[51] Int. Cl.[2] ..... E21C 13/04; E21C 13/00

[52] U.S. Cl. ..... 175/394; 175/409

[58] Field of Search ..... 175/382–386, 175/388, 391, 409, 410, 394, 18, 323

[56] References Cited

U.S. PATENT DOCUMENTS

| | | | |
|---|---|---|---|
| 1,332,841 | 3/1920 | Jansen | 175/384 |
| 1,504,852 | 8/1924 | Wright | 175/385 |
| 1,858,744 | 5/1932 | Lunsford | 175/385 |
| 2,504,978 | 4/1950 | Henning | 175/388 |
| 2,644,670 | 7/1953 | Baker et al. | 175/410 |
| 2,644,673 | 7/1953 | Baker | 175/410 |
| 2,673,717 | 3/1954 | Bacon | 175/410 |
| 2,887,300 | 5/1959 | Meredith | 175/386 |
| 2,972,389 | 2/1961 | Green et al. | 175/386 |
| 3,117,637 | 1/1964 | Mortensen | 175/410 X |
| 3,447,616 | 6/1969 | Granat | 175/294 |

*Primary Examiner*—James A. Leppink

*Attorney, Agent, or Firm*—Irving M. Weiner; Pamela S. Austin

[57] ABSTRACT

A drilling apparatus, especially for boring holes in the earth, having a drill as an integral unit including a first portion for starting the hole, a second portion for reaming the hole, and a third portion for maintaining the hole cylindrical. The drill is selectively fastened to a conventional auger. Extension plates may be attached to the third portion for drilling holes of different diameters. As an alternate embodiment, the first portion of the drill may include an auger, the drill and the auger being formed from a flat stock. At least some of the sides or cutting edges of the first, second or third portions being carbided or fabricated from extremely hard steel.

1 Claim, 12 Drawing Figures

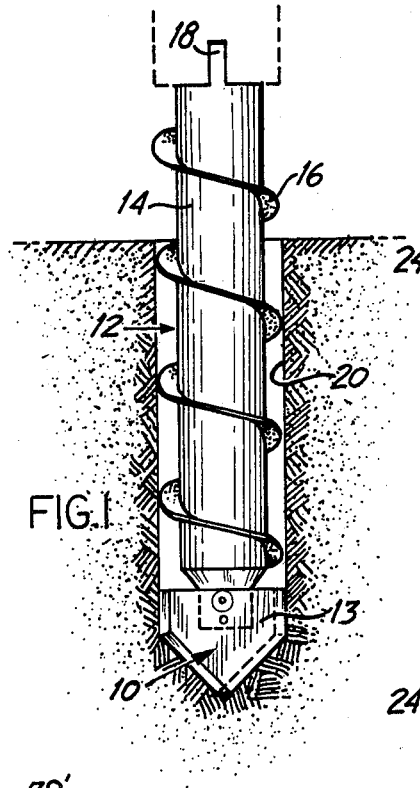
FIG.1
FIG.2
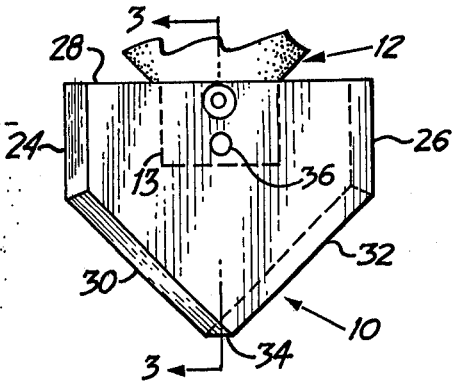
FIG.3
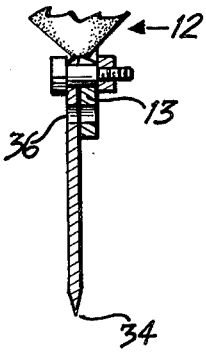
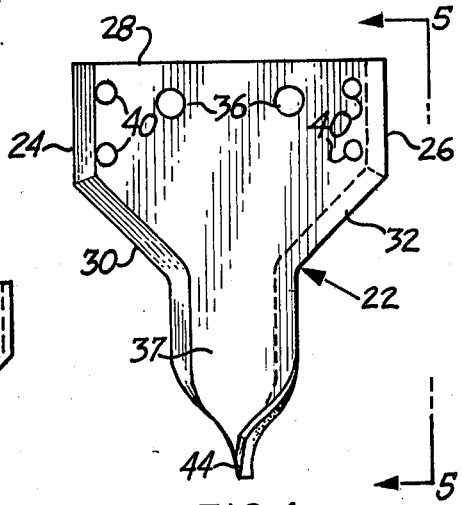
FIG.4
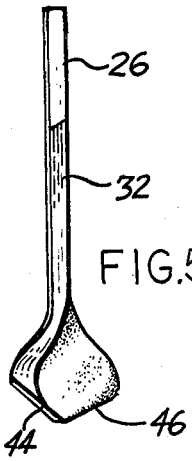
FIG.5
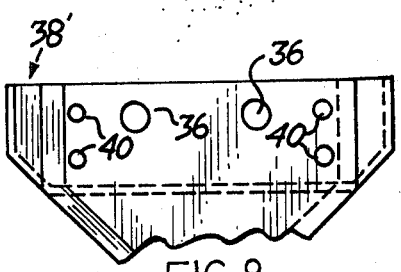
FIG.8
FIG.7
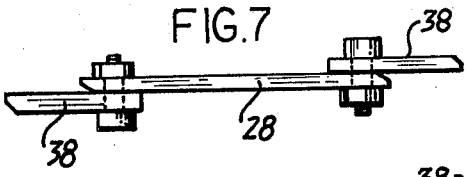
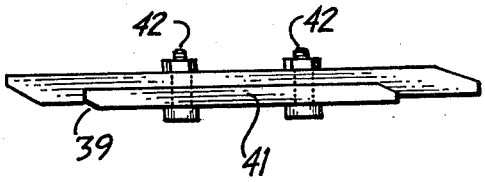
FIG.9
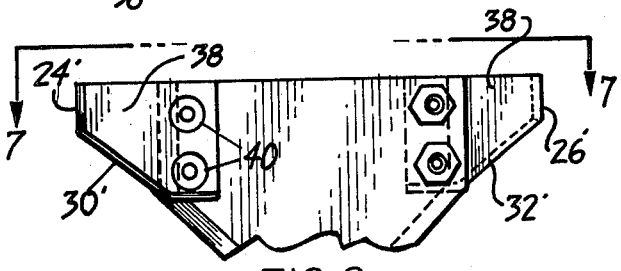
FIG.6
INVENTORS
DONALD M. DEWAR
JAMES WILSECK
BY Irving M. Weiner
ATTORNEY INVENTORS
DONALD M. DEWAR
JAMES WILSECK
BY Irving M. Kleiner
ATTORNEY

DRILLING HEAD

This is a continuation of application Ser. No. 165,654 filed July 23, 1971 which is a continuation-in-part of application Ser. No. 58,114 filed July 24, 1970.

The present invention relates generally to a drilling apparatus, and more particularly, to an attachment for the working or cutting end of a conventional auger. Some preferred embodiments of the present invention take the form of earth drilling and boring apparatus.

BACKGROUND OF THE INVENTION

The prior art drilling apparatus utilizes augers which may include a lead or pilot bit for starting the hole in the earth, reamers for boring the hole to the desired diameter, and fluted or spiral screw flight augers for removal of earth through the top of the hole.

Various problems exist with the prior art drilling apparatus. For example, when drilling through frozen earth or rock the pilot portion, which may have been welded, soldered or riveted to the reamer, often broke off. Also, when the cutting edge of the pilot or reamer became blunt or dull from use it was necessary to replace the entire apparatus. In addition, sharpening the prior art earth drilling implements resulted in corresponding undesired decreases in the diameter of the hole being bored. Finally, the prior art drills were capable of boring a hole of a single diameter; to bore holes of different diameters a new pilot, reamer and auger unit were required.

SUMMARY OF THE INVENTION

The present invention provides a drilling apparatus comprising a first portion for starting the drilling, and a second portion for boring a hole to a first predetermined diameter. The drilling apparatus also includes a third portion having its sides disposed substantially perpendicular to the first predetermined diameter for maintaining the apparatus in a proper centered alignment. The first portion, the second portion, and the third portion of the apparatus are formed as an integral unit. The third portion is adapted to be selectively connected to rotatable means for rotating the integral unit to drill a substantially smooth-sided hole. In the preferred embodiment of the present invention, at least some of the sides or cutting edges of the first portion, the second portion, or the third portion are carbided or fabricated from extremely hard steel.

The present invention also provides a drilling apparatus with the aforementioned characteristics wherein the rotatable means includes a rotatable auger for removing loose material drilled by the integral unit. The greatest diameter of the rotatable auger being less than or equal to the greatest diameter of the third portion of the integral unit. The integral unit is formed or fabricated from material which possess a hardness and a durability which exceeds the hardness and durability of the material from which the rotatable auger is formed or fabricated.

Accordingly, with the aforementioned prior art problems in mind, it is an object of the present invention to provide a novel attachment for a conventional auger, especially for use in earth drilling.

It is another object of the present invention to provide an easily replaceable earth boring pilot and reamer.

It is a further object of the present invention to provide an earth boring apparatus which may be sharpened without a corresponding decrease in the diameter of the bored holes.

It is yet another object of the present invention to provide an earth boring attachment for boring holes of different diameters.

These and other objects are accomplished in an earth boring drill which may be attached to a conventional auger. The drill includes a reamer for boring out the hole to the desired diameter, and may include a pilot auger. The reamer is adapted to receive extensions for boring holes of different diameters. When the reamer includes a pilot auger, the reamer and auger are formed from a single piece of flat stock.

BRIEF DESCRIPTION OF THE DRAWINGS

The above-mentioned objects of the invention, together with other objects and advantages which may be attained by its use, will be more fully appreciated upon reading the detailed description of the invention in conjunction with the drawings. In the drawings, wherein like numerals identify similar parts:

FIG. 1 is an illustration of a conventional earth drilling auger having a first embodiment of the present invention attached thereto;

FIG. 2 illustrates an enlarged view of the first embodiment of the basic drill of the present invention;

FIG. 3 is a sectional view of the basic drill of the present invention taken along the line 3—3 of FIG. 2;

FIG. 4 depicts a second embodiment of the drill of the present invention;

FIG. 5 illustrates an end elevational view of the second embodiment of the drill of the present invention taken along the line 5—5 of FIG. 4;

FIG. 6 shows one embodiment of the extension plate which permits the basic drill of FIGS. 1, 2, 3, 4 and 5 to bore holes of different diameters;

FIG. 7 illustrates a top plan view of the combined basic drill bit and extension plates of the present invention taken along the line 7—7 of FIG. 6;

FIG. 8 illustrates an alternate embodiment of the extension plate of FIGS. 6 and 7;

FIG. 9 illustrates an alternate embodiment of the extension plate of FIGS. 6, 7 and 8;

DETAILED DESCRIPTION OF THE INVENTION

Figure 10:
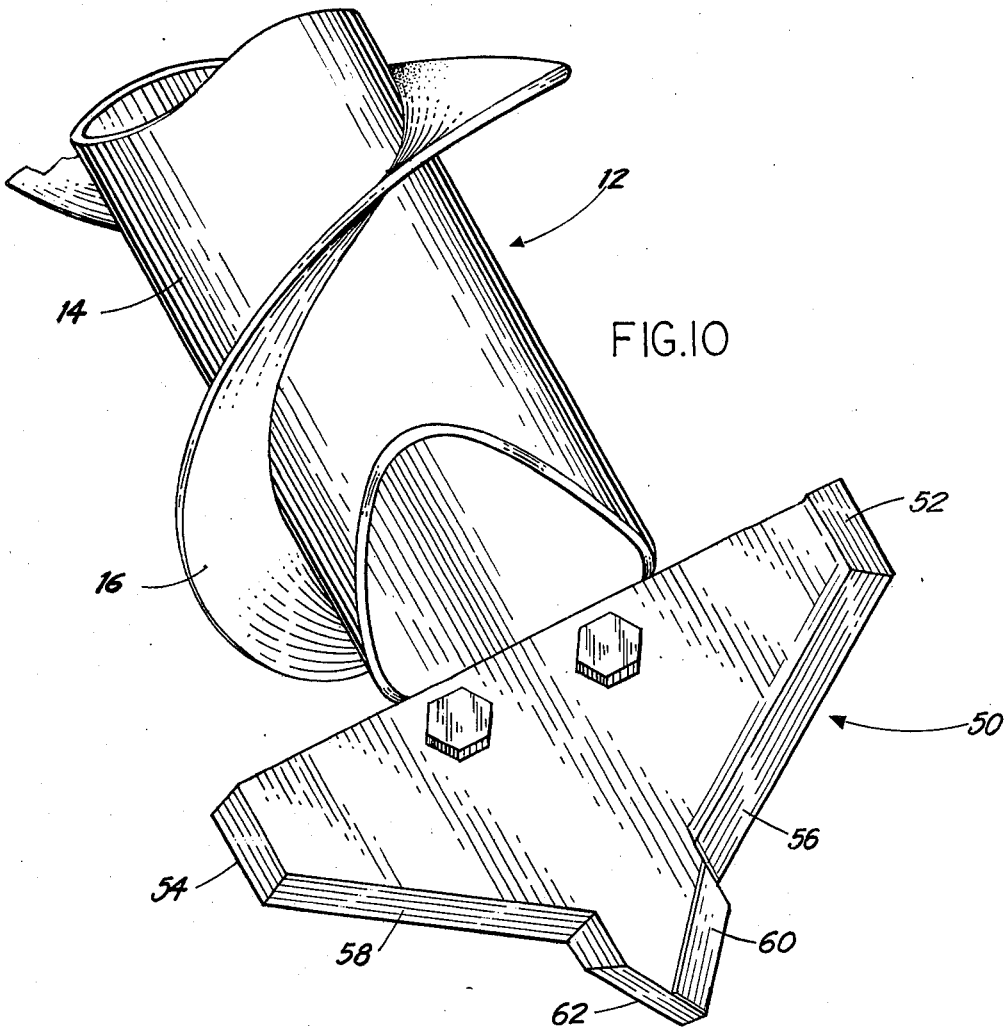
FIG. 10 depicts an isometric or perspective view of a carbided drill blade according to the present invention which is bolted to an auger.

Referring first to FIG. 1 the portions of an earth-digging or earth-drilling apparatus are illustrated. The drilling apparatus includes a lower cutting bit or integral unit 10 and an upper auger or earth removal portion 12. Conventionally, the upper portion may include a central shaft 14 and a spiral screw flight 16. The screw flight 16 may be single or multiple fluted, and a single fluted flight is shown for illustrative purposes only. The central shaft 14 terminates in an upper shaft 18 which is connected to drive means (not shown). Operation of the drive means rotates the central shaft 14 causing the cutting bit 10 to dig into the earth, and causing the upper portion 12 to transport the drilled or loosened material or earth substantially vertically upwards out of the hole 20.

As explained previously, since the prior art blade or bit and auger were a single unit, the problems with the prior art drills include the inability to replace the worn out cutting edge or bit economically and the inability to use the same shaft 12 to bore holes of different diameters. To this end the present invention is directed to a drill bit attachment 10 for the upper removal portion or upper auger 12.

A first embodiment of such an attachment is illustrated somewhat enlarged in FIGS. 2 and 3. The plate or drill bit 10 of FIGS. 1 and 2 may be made of hardened steel, and may be adapted to be attached to the bottom of an upper auger 12 in lieu of making a single integral unit as done in the prior art. The drill bit 10 may be a five-sided plate including two vertically disposed parallel sides 24 and 26, and a upper side 28 perpendicular to and connecting the parallel sides 24 and 26. Opposite to side 28 are two sloping sides 30 and 32 which meet an edge or first portion 34.

The drill bit 10 may contain holes 36 for bolting or attaching the drill bit 10 to the lower end of the upper auger 12. The edges of the vertical and sloping sides 24, 26, 30 and 32 are sharpened or beveled to provide lands for facilitating cutting through the earth.

In operating, the rotation of shaft 18 causes a corresponding rotation of drill plate or bit 10. The first or lead portion 34 bites into the earth and starts drilling the hole. The second portion, which includes the two sloping sides 30 and 32, bores or reams out the hole 20 as the lead edge 34 bites deeper. As the hole 20 is drilled and reamed, the auger 12 removes the loosened dirt in a conventional manner. The sloping sides 30 and 32 bore or ream the hole 20 to a given or first predetermined diameter which is equal to the length of the top side 28 of the drill bit 10.

The vertical sides 24 and 26 are also sharpened or beveled and perform three basic functions. First, the vertical sides 24 and 26 help to center and to keep centered the plate or drill bit 10 within the hole 20. Thus, a substantially cylindrical hole 20 is bored into the earth, rather than an undesirable distorted or oval or elliptical hole. Second, the sharpened edges 24 and 26 do some cutting to smooth out the drilled hole 20.

It is apparent that any drill bit will become dull or worn through use. When this occurred in the prior art devices, it was necessary to replace the entire unit. It was not feasible to merely sharpen the prior art bit since a smaller diameter hole would result. Thus, the third function of the vertical sides 24 and 26 of the present invention is to retain the overall size or effective drilling diameter of the cutting bit 10 even though the sloping sides 30 and 32 may be sharpened repeatedly. Furthermore, during such sharpening it is only necessary to remove the drill bit 10 from the auger 12 and fasten a new drill bit in place. Not only will the upper auger 12 last virtually indefinitely, but it is not out of service for any great length of time because new bits can easily and quickly be attached and removed at the drilling locations.

Referring next to FIGS. 4 and 5, a second embodiment 22 of the drill bit is shown. This second embodiment is similar to the embodiment of FIGS. 1, 2 and 3 except that it includes a pilot auger 37, instead of merely a pilot or lead edge 34. The pilot auger 37, which is preferably double-fluted, provides a better drilling and/or starting tool, especially in extremely hard material or frozen earth or rock. The remainder of the drill 22 of FIGS. 4 and 5 is the same as the drill 10 of FIGS. 1, 2 and 3 with the exception of the location of the holes 36 for attachment of the drill bit 22 to the auger 12 and for attachment of extension members (hereinbelow described) to the drill bit 22. The purpose of this different location is illustrative of an alternate arrangement for attaching bit 22 to auger 12. Either arrangement of holes 36 may be used with either the first or second embodiment.

Referring next to FIGS. 6 and 7, another feature of the present invention will be explained. As indicated previously, in addition to the problem of replacing worn drill bits, the prior art devices did not permit either the use of the same pilot or the same auger to bore holes of different diameters. The extension members or plates 38 illustrated in FIGS. 6 and 7 are adapted to be affixed to the drill bit of FIG. 2 or FIG. 4, and the combination is attached to the lower portion of upper auger 12. The extension members or plates 38 correspond to the shape of the upper portion of drill bit 10 or 22, and have sloping sides 30' and 32' and vertical sides 24' and 26' which are sharpened. However, when the holes 40 of plates 38 are aligned with holes 36 in drill bit 10 or 22, it will be appreciated that the plates 38 extend outwardly past the edges 24 and 26. Thus, cutting edges 24' and 26' of plates 38 are exposed to ream a larger diameter hole. It should be appreciated that plates 38 may be affixed to the same or opposide sides of bit 10 or 22, may be of any size, depending upon the diameter of the hole which is to be bored, and when plates 38 are removed to be sharpened the basic drill bit 10 or 22 is in place and still operable.

Referring next to FIG. 5, a different embodiment 38' of the extension plates 38 of FIGS. 6 and 7 is shown. Functionally, the extension member or plate 38' of FIG. 8 operates somewhat similar to the plates 38 of FIGS. 6 and 7. The extension plate 38' may also be placed on either embodiment of the basic drill 10 or 22. The particular configuration of the holes and the method of bolting, screwing or fastening the plates and drill are in the main within the knowledge of those skilled in the art. However, it has been found in practice that the bolts employed for attaching the novel drill bit 10 or 22 to the auger 12, and employed for connecting the extension members or plates 38 or 38' to the drill bit 10 or 22, should be of the smooth shoulder bolt type, rather than bolts having a screw thread provided along the entire length of the bolt shank. Use of this latter type of bolt invariably results in a wearing down of the threads with a resultant wobbling and play in the connection.

When an extension member 38 or 38' is attached to a basic drill bit, it must be realized that the overall geometry and weight distribution of the combined bit is changed. Referring to FIG. 9, a top view of an extension member or plate 38' and a basic drill 10 combination is shown with the two members fastened by bolts 42. However, in the embodiment of FIG. 9, a portion of the material of extension plate 38' has been removed to form a slot or recess 39, and the drill 10 fits into the region where such material was removed. By this arrangement the weight distribution is not substantially changed by the addition of extension plate 38, and the axis of rotation 41 of the drill bit 10 is brought as close as possible to the axis of the extension member 38' which latter axis is parallel to such axis of rotation 41. This prevents uneven stress being placed on the drill bit 10, the auger 12 and its drive shaft 18, and also permits boring a centered, round hole rather than a distorted hole.

In view of the fact that it is one of the objectives of the present invention to extend the useful life of the auger 12 very considerably by having the novel drill bit perform the cutting or drilling work, while relegating the auger 12 to perform merely the function of carrying the drilled or loosened material out of the hole being drilled, when the greatest or largest effective drilling diameter of the drill bit is substantially equal to the greatest diameter of the auger 12 to perform merely the function of carrying the drilled or loosened material out of the hole being drilled, when the greatest or largest effective drilling diameter of the drill bit is substantially equal to the greatest diameter of the auger 12, it is especially important that the drill bit be fabricated from a material which possesses a hardness and a durability which exceeds the hardness and durability of the material from which the auger is fabricated or formed. It should be appreciated that the greatest diameter of the auger 12 can perform perfectly well with a hard drill bit having a diameter which exceeds the greatest diameter of the auger 12. For example, in conventional fence post hole drilling it is quite feasible to use a 4 inch diameter auger 12 with a novel drill bit according to the present invention which can drill a hole to a 4 inch diameter, or a 5 inch diameter, or a 6 inch diameter using the same 4 inch diameter auger 12.

In practice, it has been found especially beneficial to use heat treated and hardened drill blades or drill bits according to the present invention fabricated from E6145, E6150, or M-2 steels. These types of steels used for the novel drill bit show little if any wear even after the drill bit has successfully bored many holes in vey hard terrain.

A typical end quench hardenability analysis of E6150 steel reveals a carbon content in the range or 0.48% to 0.53%, a manganese content in the range or 0.70 to 0.90%, a phosphorus content of 0.025% maximum, a sulphur content of 0.025% maximum, a silicon content in the range of 0.20 to 0.35%, a chromium content in the range of 0.80 to 1.10%, a vanadium content of 0.15% minimum, and a grain size of 5.7.

The carbon content is the only difference between the E6150 steel and the E6145 steel, the carbon content in E6145 steel being in the range of 0.43% to 0.48%. Either type of steel can be used in the making of the novel drill bit 10 or 22. Both types of steel will heat treat substantially the same, and will hold up the same when drilling in the ground. It has been found advantageous to heat treat the novel drill bit 10 or 22 at 60 Rockwell, and to stress draw down to 52 Rockwell.

With reference again to FIGS. 4 and 5, it should be borne in mind that the primary or main cutting or drilling operation is performed by the slanted or oblique lands 30 and 32 and the angled or oblique pilot cutting surfaces 44 and 46. Because these slanted or sloping surfaces do the bulk of the cutting or drilling, these surfaces are likely to be exposed to the greatest danger of wear or dulling. Accordingly, the present invention contemplates an embodiment where the slanted lands 30 and 32 and the angled pilot surfaces 44 and 46 are carbided or fabricated from extremely hard steel to assure that these surfaces are hard enough and possess sufficient strength to withstand any possible wearing exposure.

The present invention also contemplates that the vertical edges as shown in the various figures may also be carbided or formed from very hard steel, such as the vertical sides 24, 26 and the vertical sides of pilot auger 37. The invention contemplates that hard steel hardened to a Rockwell hardness of 56-58 may be satisfactorily employed.

Although it has been indicated above that a smaller diameter auger 12 may operate satisfactorily with a larger diameter drill bit, it should also be pointed out that it is equally satisfactory, if not better, under certain conditions, to employ an auger 12 and a depending harder drill bit which have the same diameter. When the diameters are the same, the likelihood of any loosened material or earth not being removed from the hole is considerably reduced.

It has been found that the best results are obtained with the present invention when the angle between the vertical side 26 and the oblique saide 32, and between the vertical side 24 and the oblique side 30, falls within the range of 30° to 70°. In particular, some very excellent practical working embodiments of the present invention have been obtained when such cutting angle was formed at 45° and 50°.

Some dimensions of a typical novel drill bit 10 as shown in FIGS. 1, 2 and 3 might be as follows: the length of side 28 is 4 inches; the length of side 24 or 26 is 1½ inches; the distance between the lead or first portion 34 and the upper side 28 is approximately 3⅛ inches; the drill bit is made from stock which is ⅜ inch thick.

Some dimensions of an exemplary novel drill bit 22 as shown in FIGS. 4 and 5 might be as follows: the length of upper side 28 is 4 inches; the length of vertical side 24 or 26 is 1½ inches; the distance between the lowermost tip of the pilot 37 to the top side 28 is 5 inches; the drill bit is made from ¼ inch flat stock.

With reference to FIGS. 1, 2 and 3, it may be necessary to affix, such as by welding, a bracket 13 on the end of the spiraled auger 12. The bracket 13 serves as the member to which the novel drill bit 10 or 22 may be connected. While the present invention embraces arrangements where the holes 36 in the bracket 13 may be used to retain the bolts which secure the drill bit and any employed extension plates, the invention also contemplates using the holes in the bracket 13 for securing the bolts which merely hold the drill bit through holes 36, while the holes 40 provided in the drill bit are used for connecting the extension plate 38 or 38' to the novel drill bit.

Figure 11:
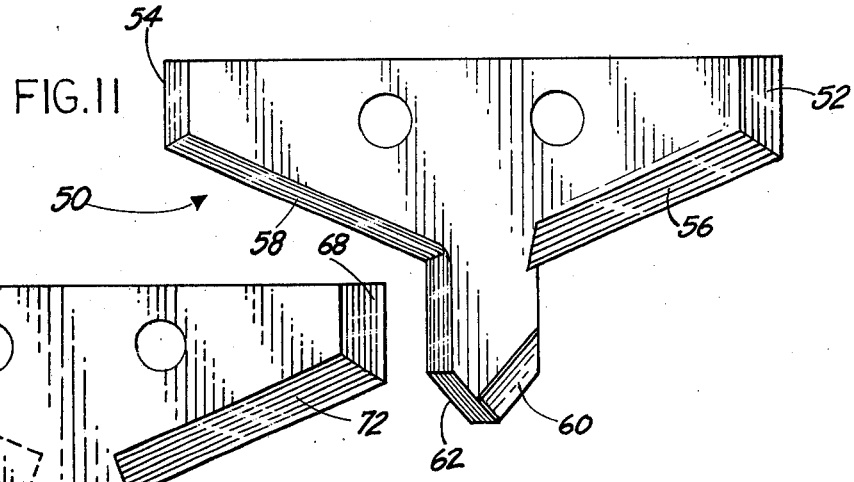
FIG. 11 shows the carbided drill blade of the FIG. 10 embodiment in an unbolted condition.

FIG. 10 illustrates another embodiment of the present invention wherein a novel drill bit or head 50 is bolted to an auger 12. The drill head 50 is shown in an unbolted condition in FIG. 11. The first, second and third portions of drill head or bit 50 are made from an integral stock of hard steel. If desired, pockets may be milled in the integral steel stock to accomodate carbiding to be placed on top of the drill. For example, FIGS. 10 and 11 show carbided edges 52, 54, 56 and 58, and 60 and 62. As an alternative, if desired the edges 52, 54, 56, 58, 60 and 62 may be made of extremely hard steel, some of which are still in stages of protection and development. It has, however, been found satisfactory to use for the basic integral drill head or blade 50 M-2 steel, or as an alternative E6150 steel.

Figure 12:
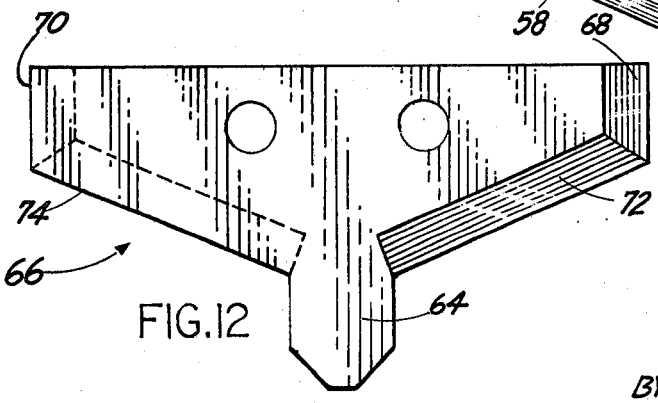
FIG. 12 illustrates a flat bladed pilot on a carbided drill head having no spiral.

FIG. 12 illustrates another embodiment of the present invention showing a flat bladed pilot 64 having no spiral thereon. It should be noticed that the drill head or bit 66 shown in FIG. 12 may also be provided with carbided or extremely hard steel edges 68, 70, 72 and 74. With reference to the embodiment of FIG. 12, if carbide is not employed on the front of the pilot 64, the steel may be heat treated to 60 Rockwell or greater.

With regard to the embodiment of the present invention illustrated in FIGS. 10 and 11, the steel is heat treated from 56 to 58 Rockwell for hardness when using carbide on all cutting angles.

With regard to the embodiments of FIGS. 2, 4, 7 and 9, all cutting angles on the drill blade can be carbided. With respect to the embodiments of FIG. 4, in addition to carbiding all the cutting angles, the front end of the spiral pilot can also be carbided.

In connection with the embodiments of FIGS. 2, 4, 6 and 8, the vertical sides 24 and 26 can also be carbided.

It is important to note that the augers 12 that are in use can be used again by putting on a new cutting blade or a new cutting pilot. If the worn cutting blade, or cutting shoe, is not replaced, it will wear the flighting 16 on the auger 12. In addition, the pressure of the cutting shoe under drilling will force the auger 12 to the opposite side of the hole 20 wearing out the flighting 16 on the opposite side of the cutting blade or cutting shoe. The foregoing transpires or occurs with the prior art augers which have only one cutting shoe or cutting blade. In contrast, the invention of the present application cuts equally off of both sides, and thereby saves the flighting 16 on the auger 12. It is also important to reiterate that the third portion of the novel drill blade of the present invention not only holds or maintains the apparatus in a propered centered alignment, but also holds the whole size which is very critical.

It has been found in practice, that the present steels of E6150 or E6145, or M-2 steel, may not hold up on cutting angles even after the steel is hardened, unless all cutting angles have carbide on them.

It has also been found satisfactory in practice to have the 4 inch, 5 inch and 6 inch diameter drill blades made of ¼ inch thick steel stock, and to have the drill blades which are over 6 inches in diameter to be made of steel stock which is 5/16 inch to ⅜ inch thick.

We claim:

1. A drilling apparatus comprising:

a first portion for starting the drilling;

a second portion for boring a hole to a first predetermined diameter;

a third portion having non-diverging parallel sides disposed perpendicular to said first predetermined diameter for maintaining said apparatus in a proper centered alignment;

said first portion, said second portion, and said third portion being formed as a substantially flat integral unit from a single piece of flat steel stock;

said first portion being adapted to be selectively connected to rotatable means for rotating said integral unit to drill a substantially smooth-sided hole;

said first portion having carbided cutting edges;

said second portion having carbided cutting edges;

said non-diverging parallel sides of said third portion being carbided; and the apparatus being detachably connectable to an auger.

* * * * *